US010914041B2

(12) United States Patent
Auer et al.

(10) Patent No.: US 10,914,041 B2
(45) Date of Patent: Feb. 9, 2021

(54) MACHINE WITH STABILIZATION ASSEMBLY, AND MEASUREMENT METHOD

(71) Applicant: Plasser & Theurer Export von Bahnbaumaschinen Gesellschaft m.b.H., Vienna (AT)

(72) Inventors: Florian Auer, Vienna (AT); Martin Buerger, Linz (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 80 days.

(21) Appl. No.: 16/068,981

(22) PCT Filed: Jan. 27, 2017

(86) PCT No.: PCT/EP2017/000103
§ 371 (c)(1),
(2) Date: Jul. 10, 2018

(87) PCT Pub. No.: WO2017/144152
PCT Pub. Date: Aug. 31, 2017

(65) Prior Publication Data

US 2019/0017226 A1 Jan. 17, 2019

(30) Foreign Application Priority Data

Feb. 24, 2016 (AT) ..... A 93/2016

(51) Int. Cl.
*E01B 27/20* (2006.01)
*E01B 33/06* (2006.01)
(Continued)

(52) U.S. Cl.
CPC ..... *E01B 27/20* (2013.01); *E01B 33/06* (2013.01); *E01B 35/00* (2013.01); *E01B 2203/01* (2013.01)

(58) Field of Classification Search
None
See application file for complete search history.

(56) References Cited

U.S. PATENT DOCUMENTS 4,181,430 A * 1/1980 Shirota ..... B61K 9/08 33/287
4,538,061 A * 8/1985 Jaquet ..... G01B 11/306 104/7.2
(Continued)

FOREIGN PATENT DOCUMENTS

DE 41 02 870 A1 8/1991
DE 41 02 871 A1 8/1991
(Continued)

OTHER PUBLICATIONS

International Search Report of PCT/EP2017/000103, dated Jun. 7, 2017.

*Primary Examiner* — Mohammed Rachedine
(74) *Attorney, Agent, or Firm* — Collard & Roe, P.C.

(57) ABSTRACT

The invention relates to a machine (1) having a machine frame (2), mobile by means of on-track undercarriages (3) on rails (4) of a track grid (5), and a stabilizing unit (8) which comprises a vibration exciter (15) for generating horizontal vibrations extending transversely to the longitudinal direction of the machine and flanged rollers (10) designed to roll on the rails (4). In this, a camera (11) is mounted on the machine frame (2) for recording a section of the track grid (5) set in vibrations, wherein the camera (11) is connected to an evaluation device (16) in order to derive from the recorded image data a resulting deflection ($s_r$) of the track grid (5). In this manner, the amplitude ($a_r$) of the sleeper deflection can be recorded, which is a measure of the actually effective vibration for stabilizing the track.

14 Claims, 3 Drawing Sheets

(51) Int. Cl.
*E01B 35/00* (2006.01)
*G01B 11/00* (2006.01)

(56) References Cited

U.S. PATENT DOCUMENTS

| | | | | |
|---|---|---|---|---|
| 5,113,767 | A | 5/1992 | Theurer | |
| 5,887,527 | A | 3/1999 | Theurer et al. | |
| 2012/0300060 | A1* | 11/2012 | Farritor | B61L 23/047 348/125 |
| 2015/0269722 | A1* | 9/2015 | Naithani | G06T 7/0004 382/104 |

FOREIGN PATENT DOCUMENTS

| | | | |
|---|---|---|---|
| EP | 0 666 371 | A1 | 8/1995 |
| GB | 2 240 570 | A | 8/1991 |
| WO | 2008/009314 | A1 | 1/2008 |

* cited by examiner

MACHINE WITH STABILIZATION ASSEMBLY, AND MEASUREMENT METHOD

CROSS REFERENCE TO RELATED APPLICATIONS

This application is the National Stage of PCT/EP2017/000103 filed on Jan. 27, 2017, which claims priority under 35 U.S.C. § 119 of Austrian Application No. A 93/2016 filed on Feb. 24, 2016, the disclosures of which are incorporated by reference. The international application under PCT article 21(2) was not published in English.

FIELD OF TECHNOLOGY

The invention relates to a machine having a machine frame, mobile by means of on-track undercarriages on rails of a track grid, and a stabilizing unit which comprises a vibration exciter for generating horizontal vibrations extending transversely to the longitudinal direction of the machine and flanged rollers designed to roll on the rails. The invention also relates to a measuring method.

PRIOR ART

A stabilizing unit is used for dynamic track stabilisation. In particular, it serves for producing a sustainable track position after lifting, lining and tamping a track in the ballast bed. During this, a horizontal vibration is generated by means of the stabilizing unit and transmitted to the track in order to bring about a better durability of the track position by joggling the track. In this way, any later settlement of the track which occurs after lifting, lining and tamping a track is considerably reduced. Additionally, the lateral displacement resistance of the track in the ballast bed is significantly increased. A corresponding machine is known, for example, from EP 0 666 371 A1 and DE 41 02 870 A1.

In WO 2008/009314 A1, a stabilizing unit with variable dynamic striking force is disclosed. In this, however, only the vibration acting upon the respective rail head of the track can be measured, but not the resulting vibration of the sleepers of the track.

SUMMARY OF THE INVENTION

It is the object of the invention to specify an improvement over the prior art for a machine of the type mentioned at the beginning. In addition, a measuring method is to be shown from which the resulting vibration of the track grid becomes apparent.

According to the invention, this object is achieved by means of a machine according to claim 1 and a method according to claim 6. Dependent claims state advantageous embodiments of the invention.

In this, a camera is mounted on the machine frame to record a section of the track grid set in vibrations, wherein the camera is connected to an evaluation device in order to derive from recorded image data a resulting deflection of the track grid. In this way, the amplitude of the sleeper deflection can be recorded which is a measure of the actually effective vibration for stabilizing the track. An accompanying improvement and documentation of the stabilizing quality are clear advantages over previous solutions.

A further development of the invention provides that the evaluation device is connected to a control of the stabilizing unit in order to actuate the vibration exciter in dependence of the resulting deflection. Thus, the possibility is created to equip the stabilizing unit with a control in order to keep the dynamic sleeper deflection constant during a working operation.

It is advantageous if the camera is designed for capturing two-dimensional images. Corresponding image data can be evaluated at the required speed by means of an industrial PC.

It is further advantageous if the camera is arranged between two flanged rollers of the stabilizing unit in a vertical plane of symmetry extending transversely to the track. The amplitude of the respective vibration period is to be expected in this region, so that a small recording angle of the camera suffices to capture the required image data.

In order to be able to take into account possible vibrations of the machine frame when determining the resulting deflection of the track grid, it is useful if an acceleration transducer is arranged on the machine frame in the region of the camera.

The measuring method according to the invention provides that image data of the vibrating region of the track grid are continuously recorded in a top view by means of the camera, and that from the recorded image data a resulting deflection of the track grid is derived. This enables a documentation of the sleeper deflection is as a relevant parameter of the frictional power of the track already during the dynamic track stabilization.

In a simple manifestation of the method, it is provided that a first image, captured at the moment of a maximal deflection in one direction, is compared to a second image, captured at the moment of a maximal deflection in the opposite direction, in order to derive from this the resulting deflection of the track grid. With this method, the resulting deflection of the track grid is precisely recorded.

In this, it is advantageous if a position deviation of image content identical in both images is evaluated as a measure of the resulting deflection of the track grid. For such a pattern recognition (matching), robust and efficient software algorithms can be used which allow a speedy and secure evaluation of the captured image data.

The evaluation is particularly efficient if contours of a sleeper and/or rail fastening means are selected as image content.

A further manifestation of the method provides that, during a vibration period of the track grid, image data are recorded at predetermined moments of capture, that for each moment of capture a deflection of the track grid is determined, and that from this a sinus-shaped vibration of the track grid is derived. The amplitude of this assumed sinus-shaped vibration then corresponds to the resulting maximum deflection of the track grid.

In order to assure sufficient precision, the images are captured at a frame rate which corresponds to at least a four-fold frequency of the horizontal vibration of the track grid. An increase of the frame rate enhances the precision, wherein the data stream to be processed increases also.

In order to further increase the evaluation efficiency, the recording of the image data and the horizontal vibration of the track grid are synchronized. As soon as synchronization has been achieved, the recordings of the two maximal deflections of a vibration period can be detected in a simple manner. Serving as reference recordings, for example, are the zero passes of the vibration which periodically show an overlapping.

A further advantage of the method comes to bear if a phase shift between a vibration of the stabilizing unit acting upon the track grid and the resulting vibration of the track grid recorded by means of the camera is determined. This phase shift serves as a measure for the mass inertia and the damping of the track grid in lateral direction. With documentation of this value, a track operator gains important information about the condition of the track.

The method is further improved if a vibration of the machine frame is measured in the region of the camera and included in the evaluation of the resulting deflection of the track grid. As soon as interfering vibrations of the machine frame occur, these are compensated during the image evaluation.

BRIEF DESCRIPTION OF THE DRAWINGS

The invention will be explained below by way of example with reference to the attached figures. There is shown in schematic representation in.

DESCRIPTION OF THE EMBODIMENTS

Figure 1:
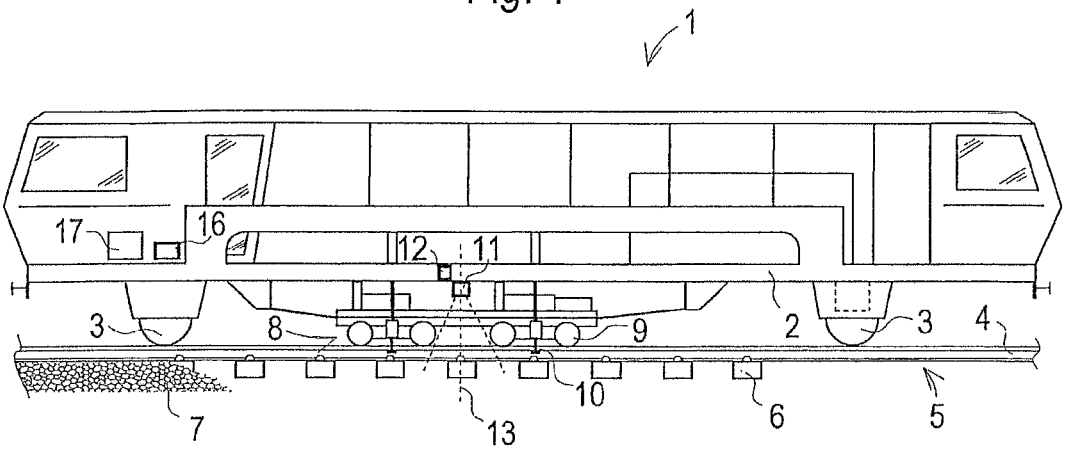
FIG. 1 a machine with a stabilizing unit

The machine 1 shown in FIG. 1 comprises a machine frame 2 which, resting on on-track undercarriages 3, is mobile on rails 4 of a track 5. The track grid 5 consists of the rails 4 and sleepers 6 and is supported in a ballast bed 7. A stabilizing unit 8 is movably connected to the machine frame 2. Said stabilizing unit 8 comprises several wheels 9 and flanged rollers 10 for gripping the track grid 5. By means of said wheels 9 and flanged rollers 10, a vibration generated by means of the stabilizing unit 8 is transmitted to the track grid 5.

According to the prior art, the motion of the stabilizing unit 8 is used as a measure of the introduced vibration. Actually, a detection of motion of the rail head of the respective rail 4 takes place here. Particularly as a result of a rail tilting occurring during the dynamic track stabilization, the rail head deflection $s_e$ does not correspond to the motion of the sleepers 6 connected to the rails 4, and thus the track grid 5. The dynamic sleeper deflection $s_r$ correlates to the relative motion between the sleepers 6 and the ballast bed 7 and is decisive for the stabilizing work introduced into the track body.

According to the invention, in order to record the resulting vibration of the track grid 5, a camera 11 is arranged on the machine frame 2. Said camera 11 comprises, for example, an image sensor installed behind a lens and takes two-dimensional pictures in top view of the track grid 5 supported in the ballast bed 7. Alternatively, other optical sensors could also be used, like a single sensor line within a line scan camera, for example.

By mounting the camera 11 on the machine frame 2, a decoupling from the vibrations of the stabilizing unit 8 which is movably suspended relative to the machine frame 2 is ensured. That is because, as a rule, due to its great mass inertia the machine frame 2 forms a stable base relative to the stabilizing unit 8.

Only in very light machines 1 is there the possibility that the machine frame 2 does not represent a sufficiently stable base. Then it is useful if an acceleration sensor 12 is arranged in the region of the camera 11 in order to register a possible vibration of the machine frame 2. This takes place, for example, by double integration of the measured accelerations. When evaluating the image data, these vibration data of the machine frame 2 serve to compensate an undesired camera motion.

Favourably, the camera 11 is arranged in a vertical plane of symmetry 13 between two flanged rollers 10 or roller tongs, so that the region of the maximum track grid deflection can be captured with an image section which is as small as possible.

Figure 2:
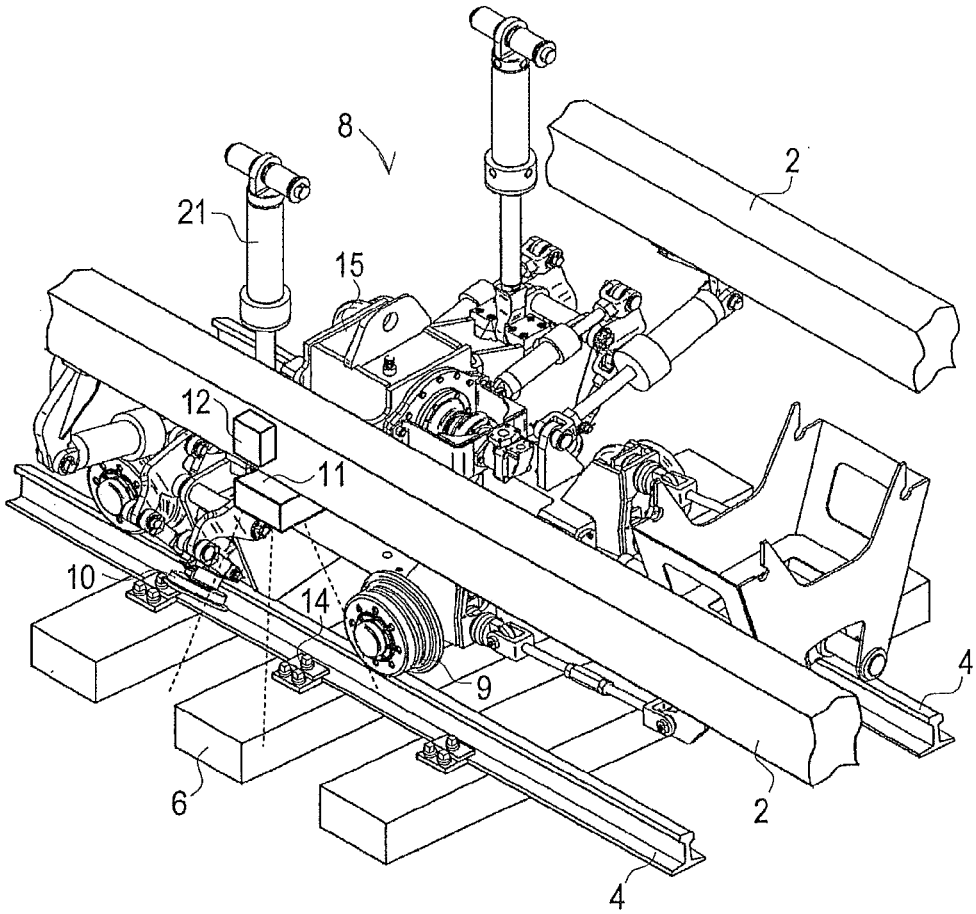
FIG. 2 a stabilizing unit

A stabilizing unit 8 is shown in detail in FIG. 2. The camera 11 is fastened to the machine frame 2 and covers the outer sleeper area. Favourably, rail fastenings 14 are also displayed to enhance the image content available for evaluation. Arranged at the center is a vibration exciter 15 which generates an either constant or adjustable vibration. In the latter case, there is the advantageous possibility to match the vibration to the recorded deflection $s_r$ of the track grid 5. The vibrations are generated, for example, by means of rotating imbalances.

On the basis of the image content, the momentary sleeper deflection $s_r$ is detected continuously by means of an evaluation device 16. The evaluation device 16 is housed, together with a control 17 of the stabilizing unit 8, in a switching cabinet, for example. For transmission of the image data, the camera 11 is connected to the evaluation device 16 by means of a data cable or via a data bus. As a rule, the control 17 is also connected to the latter.

Figure 3:
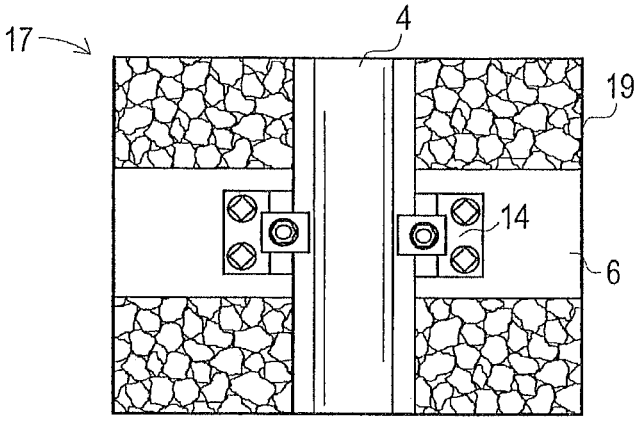
FIG. 3 an image at maximum deflection in one direction
Figure 4:
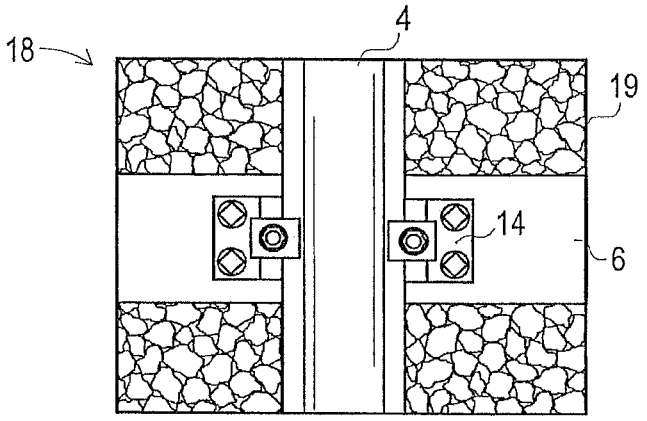
FIG. 4 an image at maximum deflection in the opposite direction

The measuring method according to the invention is based on the continuous recording of images of the track grid 5 set in vibrations. In the present example, pictures are taken of the respective upper sleeper surface with the rail fastenings 14, shown in FIGS. 3 and 4. FIG. 3 shows a first image 17 at the time of maximum deflection in one direction, and FIG. 4 shows a second image 18 at the time of a maximum deflection in the opposite direction. To record evaluable images 17, 18, a short exposure time and a high frame rate are required. Favourably, the frame rate is significantly higher than the frequency of the stabilizing unit 8.

If the frame rate corresponds to the four-fold frequency of the stabilizing unit 8, four images are captured per vibration period. A synchronization of image recording and vibration then takes place in a simple manner by varying the frame rate until every other image shows an overlapping of the image contents in the transverse direction of the track. These pictures are then images of the zero passages of the track grid 5 set in vibrations.

Based on the permissible assumption that a maximum deflection $a_r$ of the track grid 5 takes place at the temporal midpoint between two zero passages, the two images 17, 18, recorded in between, of a vibration period show just these maximum track grid deflections $a_r$. The first image 17 shows the maximum deflection in one direction, and the second image 18 shows the maximum deflection in the opposite direction.

Alternatively, the synchronization can take place via a linked actuation of the vibration exciter 15 and the camera 11. This is expedient if the stabilization unit 8 is actuated in dependence upon the detected deflection of the track grid 5 anyway. For example, the phase position and the rotational speed of the vibration-generating imbalances is matched to the frame rate.

In the event of a sufficiently high frame rate, no synchronization is required. In this case, at first the position of corresponding image content is determined in each recorded image by means of the evaluation device. From this, an image cycle for a vibration period can be deduced, wherein those two images are selected of which the corresponding image contents show the greatest deviation from one another. In this, the first image 17 shows the maximum deflection of the track grid 5 in one direction, and the second image 18 shows the maximum deflection in the opposite direction.

The vibration amplitude as a measure of the maximum deflection $a_r$ of the track grid 5 is determined by superimposition of the first and second images 17, 18. Either both images 17, 18 are overlapped with their image borders 19 aligned and the distance between corresponding image contents is determined, or the corresponding image contents are overlapped and a position deviation of the two image borders 19 from one another is evaluated as a measure of the resulting vibration amplitude.

Figure 5:
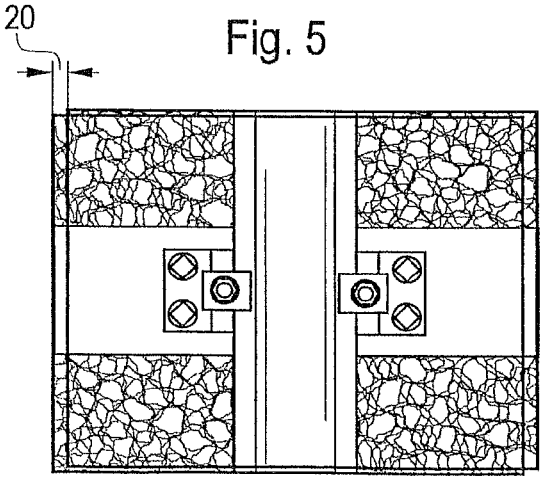
FIG. 5 evaluation with pattern recognition

FIG. 5 shows a superimposition of the two images 17, 18 from FIGS. 3 and 4. In this, the corresponding image contents are overlapped by means of pattern recognition. For this kind of matching, algorithms are known which supply sufficiently precise results in real time. The position deviation of the image borders 19 from one another indicates the peak-peak value 20 of the resulting vibration. Thus, the amplitude as maximum deflection $a_r$ of the track grid 5 in one direction is half as big.

Figure 6:
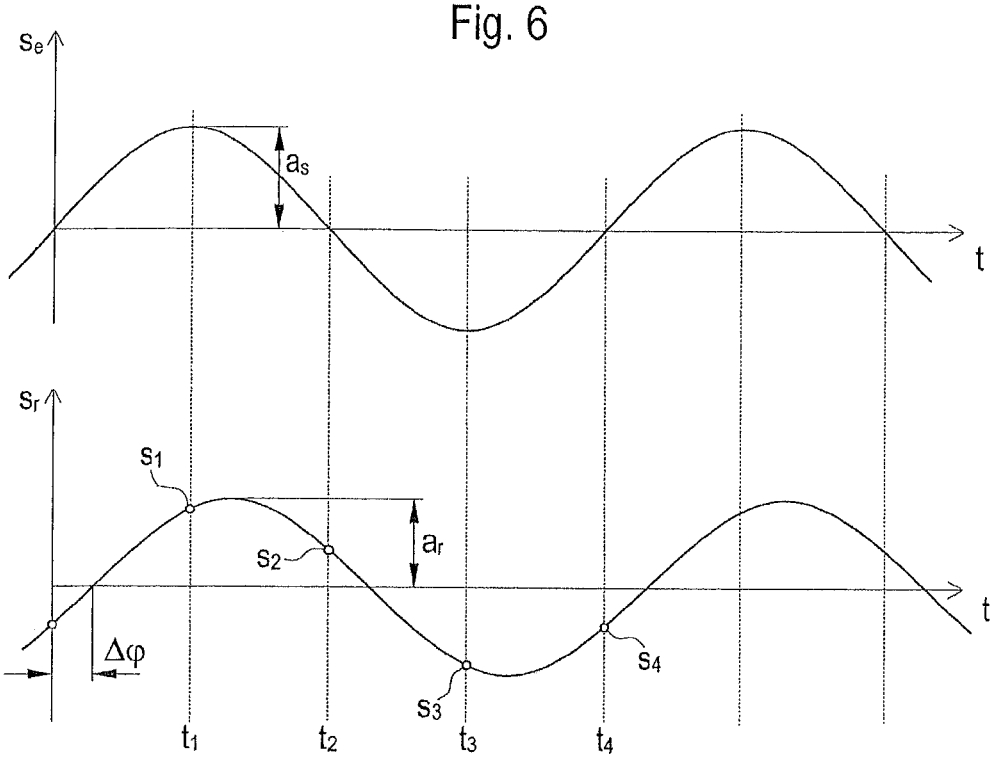
FIG. 6 vibration progression

In FIG. 6, the upper diagram shows a vibration progression of the stabilizing unit, or the rail head deflection $s_e$ over the time t. In the lower progression, the resulting deflection of the track grid 5 or the dynamic sleeper deflection $s_r$ over the time t is shown. In this, the dynamic behaviour of the track body determines a deviation between the amplitudes $a_s$, $a_r$ of these vibration progressions.

Between the vibration progressions, a phase shift $\Delta\varphi$ exists. The latter is influenced by the elasticity of the rails 4 and the stability of the rail connections 14. Further factors of influence are the friction between the sleepers 6 and ballast bed 7 as well as a vertical pressing force, acting upon the stabilizing unit 8, which is applied by means of hydraulic cylinders 21. A recording of the phase shift $\Delta\varphi$ thus documents the quality of the track body, particularly of the rail fastenings 14.

In the illustration, as an example, four moments of capture $t_1$, $t_2$, $t_3$, $t_4$ are indicated per vibration period. From the images recorded at these moments of capture $t_1$, $t_2$, $t_3$, $t_4$, the respective sleeper deflection $s_1$, $s_2$, $s_3$, $s_4$ is determined. This takes place by means of pattern recognition, wherein the change in position of a rail fastening 14 is registered, for example. In an embodiment of the measuring method according to the invention, a resulting sinus line is calculated from the detected progression points, wherein this assumed sinus line indicates the maximum resulting deflection $a_r$ of the track grid 5.

The invention claimed is:

1. A machine for running on rails of a track grid, the machine comprising:

a machine frame, a plurality of on-track undercarriages, wherein the machine is mobile by means of said on-track undercarriages;

a stabilizing unit which comprises a vibration exciter for generating horizontal vibrations extending transversely to the longitudinal direction of the machine flanged rollers designed to roll on the rails;

a camera mounted on the machine frame and configured to record a section of the track grid set in vibrations wherein said camera is configured for continuously taking two dimensional images, and an evaluation device wherein that the camera is connected to said evaluation device in order to derive from recorded image data a resulting deflection ($s_r$) of the track grid; and wherein the two-dimensional images are captured at a frame rate which corresponds to at least a four-fold frequency of the horizontal vibration of the track grid.

2. The machine according to claim 1, wherein the evaluation device is connected to a control of the stabilizing unit in order to actuate the vibration exciter in dependence of the resulting deflection ($s_r$).

3. The machine according to claim 1, wherein the camera is arranged between two flanged rollers of the stabilizing unit in a vertical plane of symmetry extending transversely to the track.

4. The machine according to claim 1, wherein an acceleration transducer is arranged on the machine frame in the region of the camera.

5. The machine as in claim 1, wherein the camera is configured such that the frame rate of the images of the recorded data is significantly higher than the frequency of the stabilizing unit.

6. A measuring method which is carried out by means of the machine according to claim 1, comprising the following steps:

continuously recording image data of the vibrating region of the track grid in a top view by means of the camera, and deriving a resulting deflection ($s_r$) of the track grid from the recorded image data;

wherein the images are captured at a frame rate which corresponds to at least a four-fold frequency of the horizontal vibration of the track grid.

7. The measuring method according to claim 6, wherein a first image, captured at the moment of a maximal deflection in one direction, is compared to a second image, captured at the moment of a maximal deflection in the opposite direction, in order to derive from this the resulting deflection ($s_r$) of the track grid.

8. The measuring method according to claim 7, wherein a position deviation of image content identical in both images is evaluated as a measure of the resulting deflection ($s_r$) of the track grid.

9. The measuring method according to claim 8, wherein contours of a sleeper and/or rail fastening means are selected as identical image content.

10. The measuring method according to claim 6, wherein, during a vibration period of the track grid, image data are recorded at predetermined moments of capture ($t_1$, $t_2$, $t_3$, $t_4$), that for each moment of capture a deflection ($s_1$, $s_2$, $s_3$, $s_4$) of the track grid is determined, and wherein from this a sinus-shaped vibration of the track grid is derived.

11. The measuring method according to claim 6, wherein the recording of the image data and the horizontal vibration of the track grid are synchronized.

12. The measuring method according to claim 6, wherein a phase shift ($\Delta\phi$) between a vibration of the stabilizing unit acting upon the track grid and the resulting vibration of the track grid recorded by means of the camera is determined.

13. The measuring method according to claim 6, wherein a vibration of the machine frame is measured in the region of the camera and included in the evaluation of the resulting deflection ($s_r$) of the track grid.

14. The measuring method as in claim 6, wherein the frame rate of the images of the recorded data is significantly higher than the frequency of the stabilizing unit.

* * * * *